US007336158B2

(12) United States Patent
Lombardo

(10) Patent No.: US 7,336,158 B2
(45) Date of Patent: Feb. 26, 2008

(54) STATUS INDICATING DOORBELL

(76) Inventor: Lori Lombardo, 81 Aarons Reef, Destin, FL (US) 32541

( * ) Notice: Subject to any disclaimer, the term of this patent is extended or adjusted under 35 U.S.C. 154(b) by 0 days.

(21) Appl. No.: 10/959,720

(22) Filed: Oct. 6, 2004

(65) Prior Publication Data

US 2006/0071762 A1 Apr. 6, 2006

(51) Int. Cl.
*G08B 3/00* (2006.01)

(52) U.S. Cl. ..... 340/330; 340/539.1; 340/825.69; 379/167.12

(58) Field of Classification Search ..... 340/330, 340/326, 328, 539.1, 500, 384.1, 531, 392.1, 340/825.69, 286.11, 392.4, 332; 379/167.12
See application file for complete search history.

(56) References Cited

U.S. PATENT DOCUMENTS

| | | | | |
|---|---|---|---|---|
| D287,704 | S | 1/1987 | Wheeler | 200/43.01 |
| 4,868,540 | A * | 9/1989 | Housley | 340/326 |
| 4,901,461 | A * | 2/1990 | Edwards et al. | 40/575 |
| 5,077,452 | A | 12/1991 | Mathers | 200/43.01 |
| 5,384,838 | A | 1/1995 | Hoffman | 379/167 |
| 5,428,388 | A | 6/1995 | Von Bauer et al. | 348/155 |
| 5,673,016 | A | 9/1997 | Lutes | 340/326 |
| 5,774,039 | A * | 6/1998 | Housley | 340/326 |
| D417,853 | S | 12/1999 | Walker | 340/330 |
| 6,185,294 | B1 | 2/2001 | Chornenky et al. | 379/350 |
| 6,236,303 | B1 * | 5/2001 | Wagner et al. | 340/286.08 |
| 6,438,221 | B1 * | 8/2002 | Lee et al. | 379/159 |
| 6,731,200 | B2 * | 5/2004 | Wagner et al. | 340/286.08 |

* cited by examiner

*Primary Examiner*—Benjamin C. Lee
*Assistant Examiner*—Daniel Previl
(74) *Attorney, Agent, or Firm*—J. Wiley Horton

(57) ABSTRACT

A doorbell unit capable of displaying several status indicators or messages next to its activation button. The activation button is located on a display panel. The user can set the display panel to show a variety of messages, including "Do Not Ring," "Ring With Care," "Welcome," or a custom text message. The display panel is preferably controlled by logic circuitry located within a controller, which replaces the conventional chime unit. A remote control is provided, so that the user can alter the status of the device without having to access the controller.

20 Claims, 4 Drawing Sheets

STATUS INDICATING DOORBELL

BACKGROUND OF THE INVENTION

1. Field of the Invention

This invention relates to the field of home accessories. More specifically, the invention comprises a doorbell which displays a status message informing a visitor whether the house is receiving guests.

2. Description of the Related Art

Electrical doorbells have been in common use for many decades. FIG. 1 shows a typical prior art device. Chime unit 14 is mounted on a wall in the interior of a house, typically in a hallway. 110VAC is provided via line power 30. Two wires run to activation button 12, which is mounted next to the front door. The two wires comprise activation circuit 16. When button 12 is pressed, a circuit is made and the tone generating chimes within chime unit 14 are activated.

The chime unit is typically loud enough to alert everyone in the home. Its activation can cause unwanted disturbance, however, in the case of sleeping infants. Since it often requires quite some time to induce sleep in an infant, once disturbed, the infant may remain awake for some time. Thus, an unwanted activation of chime unit 14 can be a big problem. It would therefore be advantageous to provide some indication as to whether visitors are welcome.

Those skilled in the art will know that the two wires comprising activation circuit 16 customarily carry a 10-16VAC potential. This potential is typically provided by a step-down transformer within chime unit 14. In a sense, the activation circuit is always "made", in that a light within the button is customarily powered by the activation circuit (thereby illuminating the button). However, the light source is a high resistance connection that allows very little current flow within the activation circuit. When the door bell button is pressed, this "makes" a low resistance connection which allows substantial current flow and the activation of the chime unit itself. The existence of the low-current 10-16VAC potential on the activation circuit is significant, since it can be used to power devices located proximate the door bell button.

BRIEF SUMMARY OF THE INVENTION

The present invention comprises a doorbell unit capable of displaying several status indicators or messages next to its activation button. The activation button is preferably located on a display panel. The user can set the display panel to show a variety of messages, including "Do Not Ring," "Ring With Care," "Welcome," or a custom text message. The display panel is preferably controlled by logic circuitry located within a controller, which can replace the conventional chime unit. A remote control is provided, so that the user can alter the status of the device without having to access the controller.

REFERENCE NUMERALS IN THE DRAWINGS

| | | | |
|---|---|---|---|
| 10 | doorbell system | 12 | activation button |
| 14 | chime unit | 16 | activation circuit |
| 18 | display panel | 20 | red indicator |
| 22 | yellow indicator | 24 | green indicator |
| 26 | text display | 28 | controller |
| 30 | line power | 32 | R/F receiver |
| 34 | tone generator | 36 | remote control |
| 38 | red button | 40 | yellow button |
| 42 | green button | 44 | menu up button |
| 46 | select button | 48 | menu down button |
| 50 | menu display | | |

DETAILED DESCRIPTION OF THE INVENTION

Figure 1:
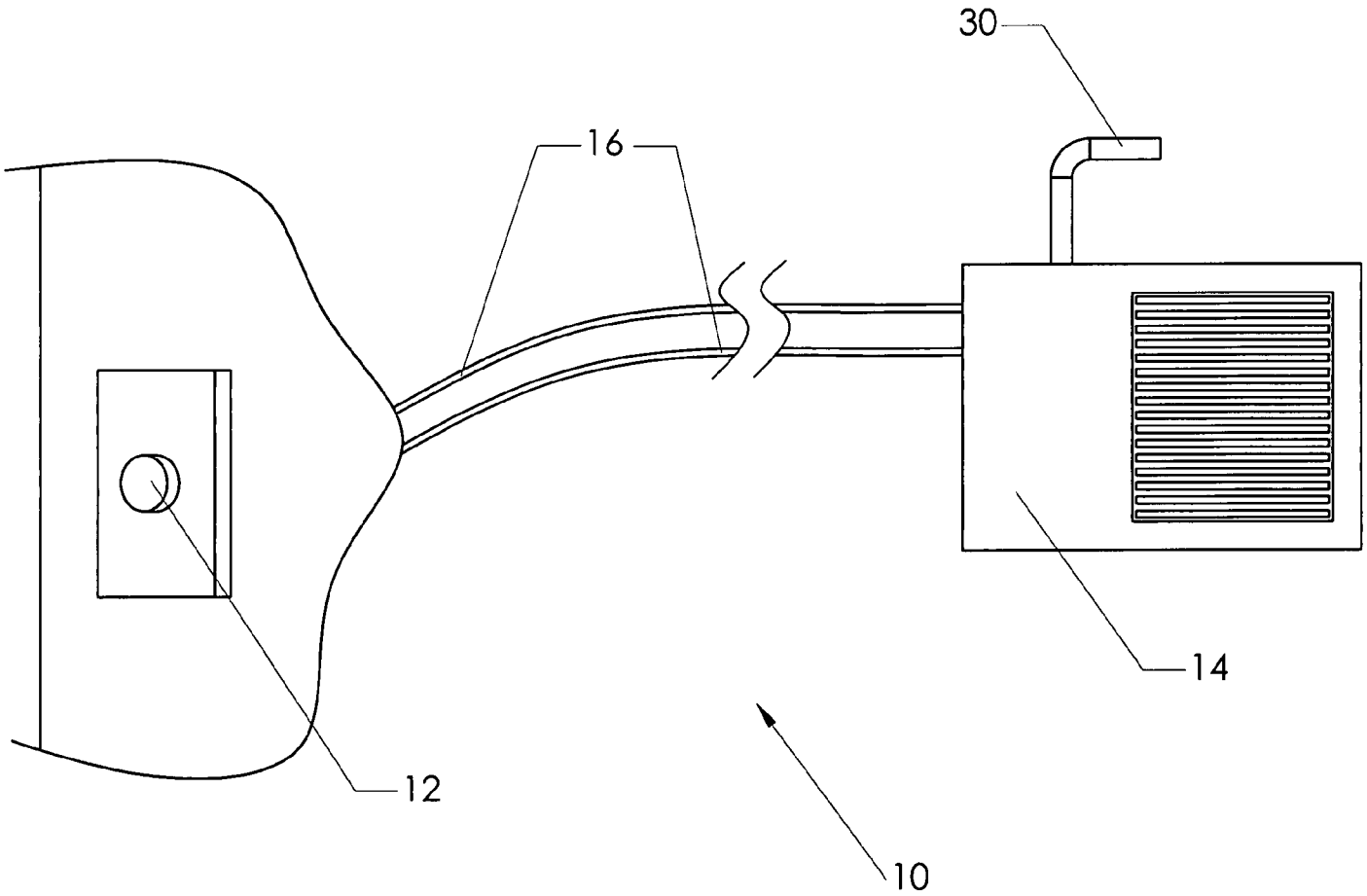
FIG. 1 (PRIOR ART)
FIG. 1 is a perspective view, showing a prior art doorbell.
Figure 2:
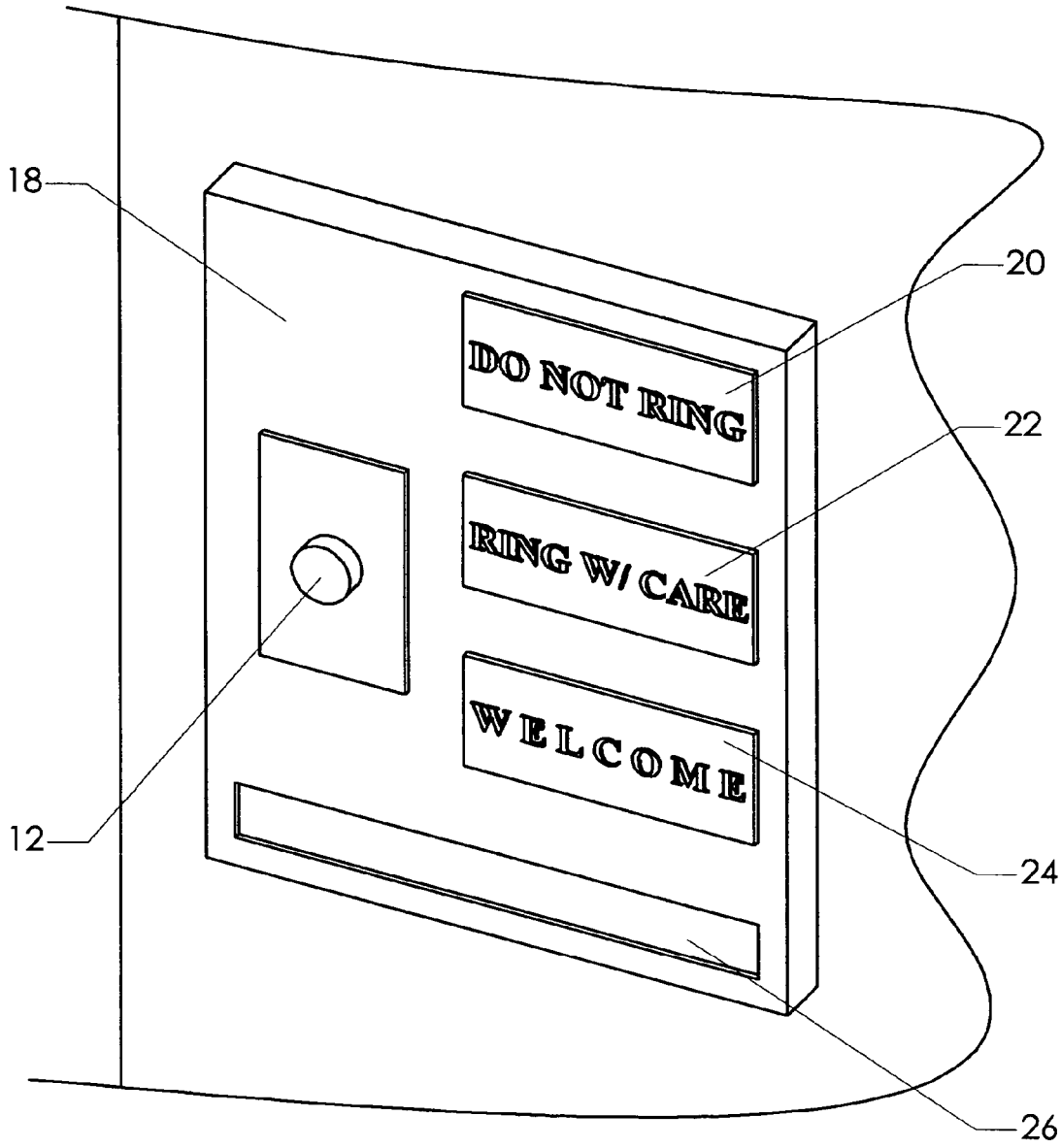
FIG. 2 is a perspective view, showing the display panel.

The preferred embodiment of the present invention is designed to directly replace the prior art activation button and chime unit. FIG. 2 shows display panel 18, which is installed in place of the prior art activation button. The display panel is electrically connected to the existing activation circuit 16. The low-current AC voltage on the activation circuit is used to power the display panel. Activation button 12 provides the same function as in the prior art; i.e., if activation button 12 is pressed, the doorbell will ring.

The display panel features three indicators near the activation button: red indicator 20, yellow indictor 22, and green indicator 24. One of the indicators can be illuminated in order to provide a "status" message to a visitor contemplating ringing the doorbell. In addition to the color cue, a text message can be provided with each indicator. The text message can be back-lit when the indicator is illuminated. Thus, for the red indicator, the message "DO NOT RING" can be included. For the yellow indicator, the message "RING WITH CARE" can be included. For the green indicator, the message "WELCOME" can be included. These particular messages are merely representative. Obviously, many different messages can be printed on the translucent cover of each indicator.

The display panel also includes a text display 26. This is typically an LCD character display. The user is able to set this display to read a variety of user-defined messages. Thus, it might be set to read "COME IN, I'M ROCKING THE BABY."

Figure 3:
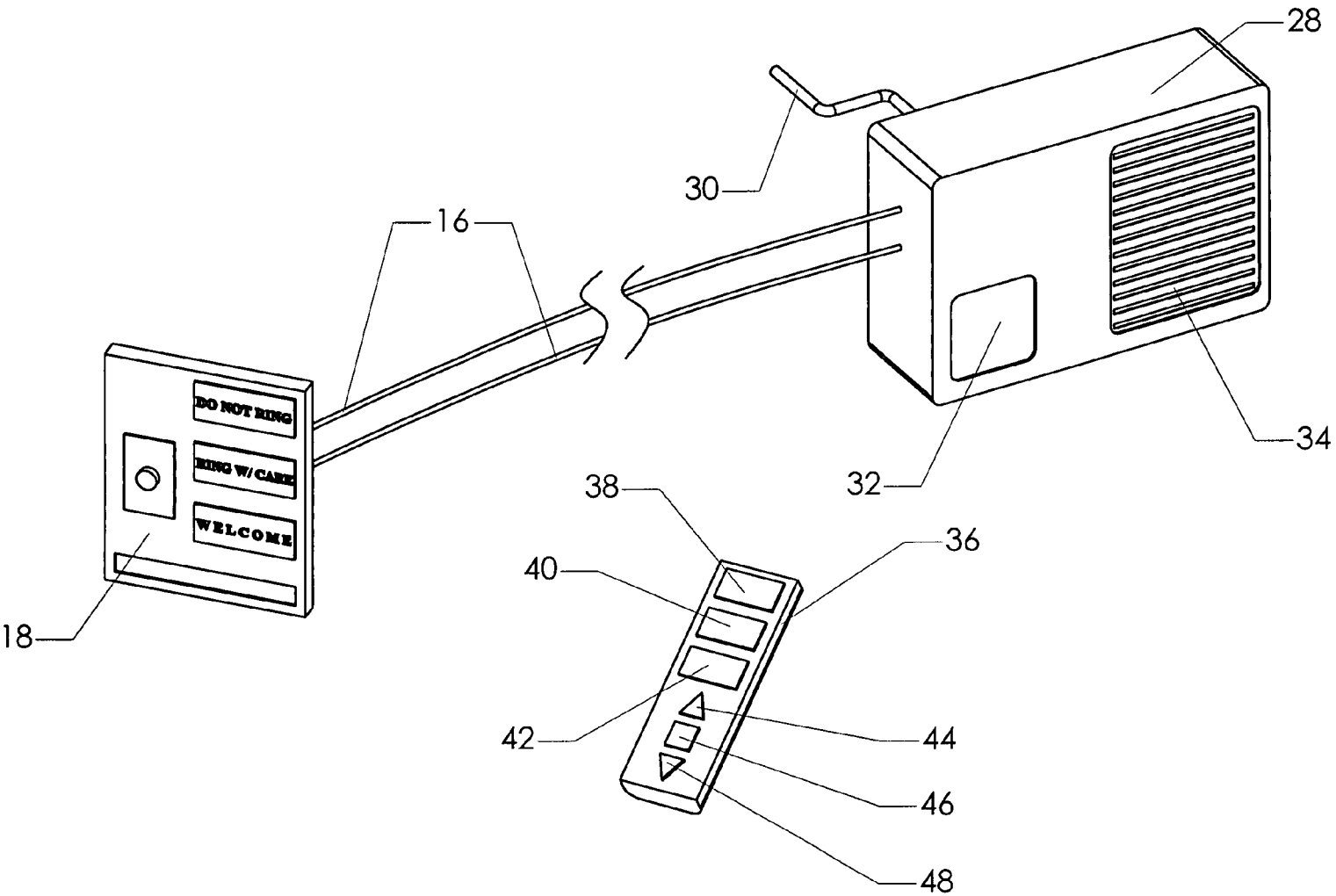
FIG. 3 is a perspective view, showing all the components of the present invention.

FIG. 3 shows all the components as they would be installed. Display panel 18 replaces the prior art activation button. Controller 28 replaces the prior art chime unit. The controller and the display panel are electrically connected using the prior art activation circuit 16. Nearly all houses have such an activation circuit in place. Thus, the present invention can be installed without running additional wiring. The controller is connected to line power 30. It contains a step-down transformer, as for the prior art chime unit.

However, controller 28 contains more features than the prior art chime unit. It contains control circuitry for sending control signals to the display panel. The display panel likewise contains control circuitry.

The user conventionally employs remote control 36 to set the desired status of the display panel. Controller 28 features R/F receiver 32 to receive signals from the remote control (The particular communication method used is not important. Infrared or ultrasonic signal transmission could be used instead of radio frequency signals). The remote control has several buttons, including red button 38, yellow button 40, and green button 42. The user presses these to activate the red, yellow, or green indicators on the display panel. The remote control also features a menu up button 44, a menu down button 48, and a select button 46.

Figure 4:
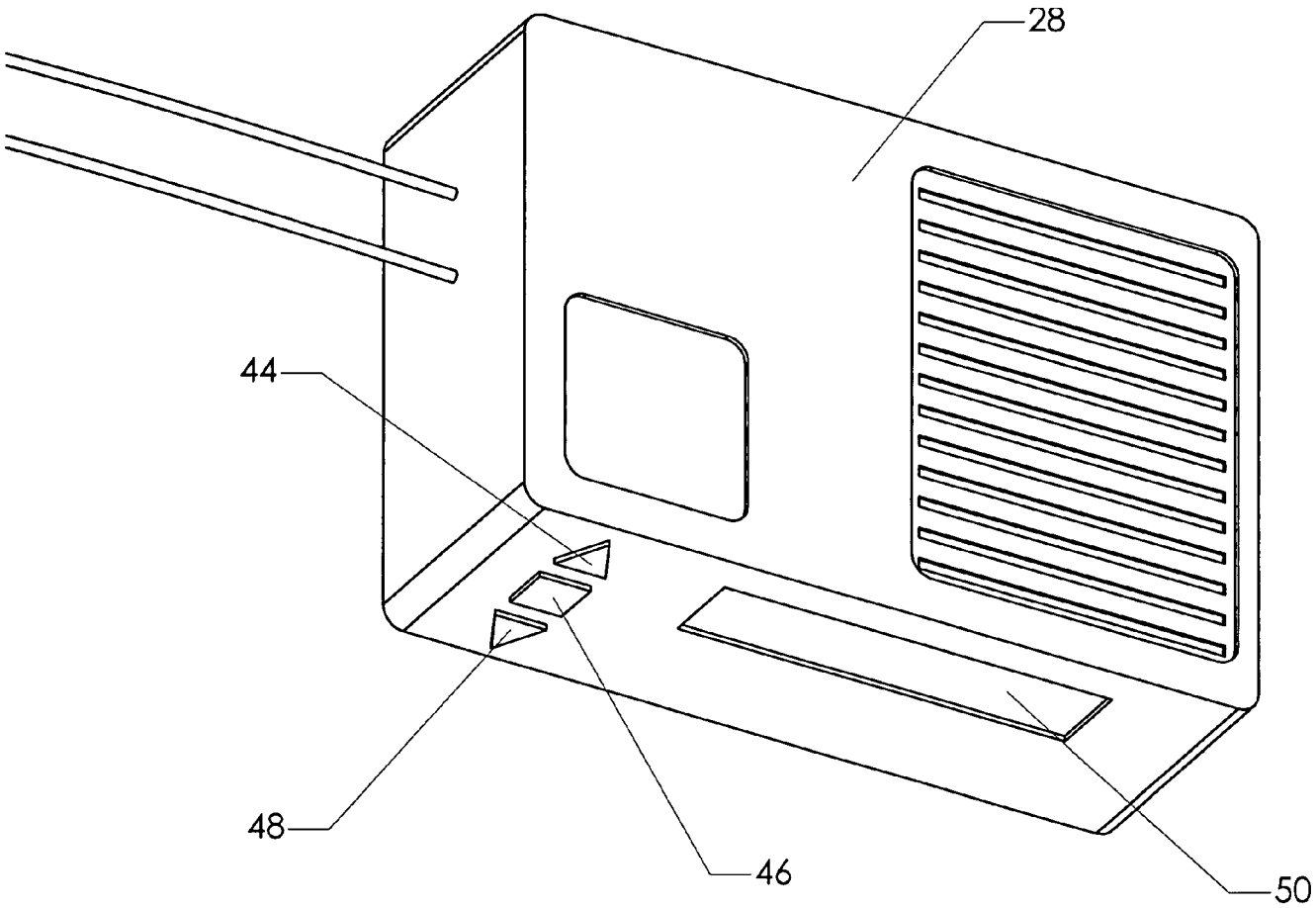
FIG. 4 is a perspective view, showing details of the controller.

Turning to FIG. 4, the reader will observe that the lower part of controller 28 features menu display 50. The controller is typically mounted high on a wall (such as in an entrance hallway). The user can look up at the controller and easily read menu display 50. The user then presses the menu up or menu down buttons on the remote control to scroll through menu options. When the desired option is displayed, the user presses the menu select button.

The menu can be used to select a variety of standard messages for text display 26. The menu can also be used to allow the user to create custom messages by scrolling through and selecting the letters in sequence.

FIG. 4 also illustrates the presence of a supplemental set of menu controls on the bottom of the controller, right next to menu display 50. An additional menu up button 44, menu down button 48, and select button 46 are provided on the controller itself. If the remote control cannot be found (or if the user does not wish to use it), these supplemental buttons can be used to set the desired configuration for the controller. The reader should note that the wires shown coming out of the side of the controller in FIG. 4 would not actually be visible. These would actually exit the rear of the unit and enter the wall on which the controller is mounted. The wires are shown as visible in FIGS. 3 and 4 so that the user will understand the use of the existing activation circuit to communicate between the controller and the display panel.

Returning now to FIG. 3, some explanation of the communication between the controller and the display panel, as well as the internal operation of both of these components, may be helpful to the reader's understanding. The controller provides a low-current AC voltage over the activation circuit. This voltage provides power to the display panel. The display panel preferably includes digital control circuitry. The indicators are preferably powered by low-current devices such as LED's.

The controller includes digital control circuitry as well. When the user makes a selection (such as the command to illuminate the red indicator), the controller encodes this as a digital signal which is then transmitted over the activation circuit. This digital signal is decoded by the digital control circuitry in the display panel. A responsive power circuit then supplies power to the red indicator. Other signals can be transmitted to illuminate the yellow indicator, illuminate the green indicator, or provide a text message. All these signals can be carried on the activation circuit, on top of the low-current AC "power signal."

When a visitor presses activation button 12, a signal is sent back from the display panel to the controller. The controller then activates tone generator 34, which sounds a desired tone (chime, buzz, or whatever the user prefers). The user is also allowed to set a lock-out feature, so that when the red indicator is illuminated, the tone will not sound.

The reader will thereby appreciate that the proposed invention provides a status display while still allowing the normal function of the prior art doorbell. The reader should be aware that although the preferred embodiment (disclosed in FIGS. 2-4) suggests removing the existing activation button and chime unit, other embodiments can be conceived where this need not be done.

A display panel having no button can simply be mounted next to an existing activation button. It is then connected to the activation circuit in parallel with the existing button. Likewise, the user can leave the existing chime unit in place, simply connecting the controller in parallel with the chime unit. The controller and display panel can then communicate via digital signals transmitted over the activation circuit. However, the conventional function of the activation unit button and chime unit will be unaffected. Thus, the present invention can be a supplement to—rather than a replacement for—an existing doorbell system.

Although the preceding descriptions contain significant detail, they should be properly viewed as providing examples of the present invention, rather than limitations on the scope of the present invention. Accordingly, the scope of the invention should be set by the following claim rather than by any particular examples provided.

Having described my invention, I claim:

1. A status indicating door bell allowing a user to display a selected status prior to a visitor activating said door bell proximate the exterior side of a door on a house, wherein said status indicating doorbell utilizes an activation circuit installed between a button and a chime unit within said house, comprising:

a. a display panel, located proximate said exterior side of said door, including
   i. a button,
   ii. at least one status indicator, said status indicator configured to inform said visitor whether said user desires said visitor to ring said doorbell, wherein said status indicator is visible prior to said visitor pressing said button;

b. a controller, located on the interior of said house remote from said display panel;

c. user interface means allowing said user to select a desired status for said at least one status indicator;

d. electronic communication means allowing said controller to set said desired status of said at least one status indicator on said display panel by sending a signal over said activation circuit; and e. a transportable wireless remote control, said transportable wireless remote control configured to actuate said status indicator.

2. A status indicating door bell as recited in claim 1, further comprising a tone generator located within said controller.

3. A status indicating door bell as recited in claim 1, wherein:

a. said at least one status indicator comprises a red indicator, a yellow indicator, and a green indicator; and b. said controller illuminates only one of said red, yellow, or green indicators at a time.

4. A status indicating door bell as recited in claim 3, wherein:

a. said red indicator displays a text message;

b. said yellow indicator displays a text message; and c. said green indicator displays a text message.

5. A status indicating door bell as recited in claim 1, wherein:

a. said at least one status indicator further comprises a text display capable of displaying a text message;

b. said user interface means allows said user to select said text message; and c. said electronic communication means allows said controller to transmit said text message to said display panel.

6. A status indicating door bell as recited in claim 1, a. wherein said transportable wireless remote control, includes a plurality of buttons allowing said user to select said desired status for said at least one status indicator, and a transmitter for transmitting signals containing said selections; and b. said status indicating door bell further comprising a receiver attached to said controller, configured to receive said signals from said remote control.

7. A status indicating doorbell as recited in claim 6, wherein said controller further comprises a menu display.

8. A status indicating door bell as recited in claim 6, wherein:

a. said at least one indicator further comprises a text display capable of displaying a text message;

b. said plurality of buttons on said remote control allows said user to select said text message; and c. said electronic communication means allows said controller to transmit said text message to said display panel.

9. A status indicating door bell as recited in claim 1, wherein said user interface means comprises a plurality of buttons located on said controller which allow said user to select said desired status for said at least one indicator.

10. A status indicating door bell as recited in claim 9, wherein said controller further comprises a menu display.

11. A status indicating door bell as recited in claim 9, wherein:

a. said at least one indicator further comprises a text display capable of displaying a text message;

b. said plurality of buttons on said controller allows said user to select said text message; and c. said electronic communication means allows said controller to transmit said text message to said display panel.

12. A status indicator allowing a user to display a selected status prior to a visitor activating said door bell proximate the exterior side of a door on a house, wherein said status indicator utilizes an activation circuit installed between a activation button located proximate said door and a chime unit within said house, comprising:

a. a display panel, located proximate said activation button, including at least one indicator, said status indicator configured to inform said visitor whether said user desires said visitor to ring said doorbell, wherein said indicator is visible prior to said visitor pressing said activation button.

b. a controller, located on the interior of said house remote from said display panel;

c. user interface means allowing said user to select a desired status for said at least one indicator; and d. electronic communication means allowing said controller to set said desired status of said at least one indicator on said display panel by sending a signal over said activation circuit; and e. a transportable wireless remote control, said transportable wireless remote control configured to actuate said status indicator.

13. A status indicator as recited in claim 12, further comprising a tone generator located within said controller.

14. A status indicator as recited in claim 12, wherein:

a. said at least one status indicator comprises a red indicator, a yellow indicator, and a green indicator; and b. said controller illuminates only one of said red, yellow, or green indicators at a time.

15. A status indicator as recited in claim 12, wherein:

a. said at least one status indicator further comprises a text display capable of displaying a text message;

b. said user interface means allows said user to select said text message; and c. said electronic communication means allows said controller to transmit said text message to said display panel.

16. A status indicator as recited in claim 12, a. wherein said transportable wireless remote control, includes a plurality of buttons allowing said user to select said desired status for said at least one status indicator, and a transmitter for transmitting signals containing said selections; and b. said status indicating door bell further comprising a receiver attached to said controller, configured to receive said signals from said remote control.

17. A status indicating doorbell as recited in claim 16, wherein said controller further comprises a menu display.

18. A status indicating door bell as recited in claim 16, wherein:

a. said at least one indicator further comprises a text display capable of displaying a text message;

b. said plurality of buttons on said remote control allows said user to select said text message; and c. said electronic communication means allows said controller to transmit said text message to said display panel.

19. A status indicating door bell as recited in claim 12, wherein said user interface means comprises a plurality of buttons located on said controller which allow said user to select said desired status for said at least one indicator.

20. A status indicating door bell as recited in claim 19, wherein said controller further comprises a menu display.

* * * * *